US010280728B2

(12) United States Patent
Bommer

(10) Patent No.: US 10,280,728 B2
(45) Date of Patent: May 7, 2019

(54) CONNECTOR AND GAS-LIQUID SEPARATOR FOR COMBINED ELECTRIC SUBMERSIBLE PUMPS AND BEAM LIFT OR PROGRESSING CAVITY PUMPS

(71) Applicant: BOARD OF REGENTS, THE UNIVERSITY OF TEXAS SYSTEM, Austin, TX (US)

(72) Inventor: Paul M. Bommer, Wimberley, TX (US)

(73) Assignee: Board of Regents, The University of Texas Systems, Austin, TX (US)

( * ) Notice: Subject to any disclaimer, the term of this patent is extended or adjusted under 35 U.S.C. 154(b) by 236 days.

(21) Appl. No.: 15/307,160

(22) PCT Filed: Apr. 22, 2015

(86) PCT No.: PCT/US2015/027062
§ 371 (c)(1),
(2) Date: Oct. 27, 2016

(87) PCT Pub. No.: WO2015/167895
PCT Pub. Date: Nov. 5, 2015

(65) Prior Publication Data

US 2017/0044888 A1 Feb. 16, 2017

Related U.S. Application Data

(60) Provisional application No. 61/985,814, filed on Apr. 29, 2014.

(51) Int. Cl.
*E21B 43/38* (2006.01)
*E21B 43/12* (2006.01)
*F04D 29/70* (2006.01)

(52) U.S. Cl.
CPC ..... *E21B 43/38* (2013.01); *E21B 43/12* (2013.01); *E21B 43/127* (2013.01); *E21B 43/128* (2013.01); *F04D 29/708* (2013.01)

(58) Field of Classification Search
CPC ..... E21B 43/38; E21B 43/127; E21B 43/128; E21B 43/12; F04D 29/708
See application file for complete search history.

(56) References Cited

U.S. PATENT DOCUMENTS 1,554,835 A * 9/1925 Barrett ..... E21B 43/38 166/105.5
1,665,540 A * 4/1928 Green ..... E21B 43/12 166/105.5

(Continued)

OTHER PUBLICATIONS

International Search Report and Written Opinion issued in Application No. PCT/US2015/027062, dated Jul. 20, 2015.

(Continued)

*Primary Examiner* — Michael R Wills, III
(74) *Attorney, Agent, or Firm* — Meunier Carlin & Curfman LLC

(57) ABSTRACT

The present invention provides a gas-liquid separator/connector having three concentric tube device made such that flow of fluids from a ESP enters the bottom and are diverted into the largest of the three concentric tubes located as the outside tube. The relatively large space between the inside tube and the outside tube allows for the gas to separate from the liquid. The gas continues to rise to the surface in the tubing-casing annulus. The liquid now can enter by gravity the third tube that is placed outside the inner tube (the tubing) and the large external tube. This third concentric tube is not as long as the large outer tube and is connected at the bottom to become the entrance to the pump intake for the beam pump or PCP. The pump intake for the beam pump or PCP is a part of the smallest inner tube of the connector.

20 Claims, 2 Drawing Sheets

(56) References Cited

U.S. PATENT DOCUMENTS

| | | | | |
|---|---|---|---|---|
| 2,214,064 | A | 9/1940 | Niles et al. | |
| 2,748,719 | A | 6/1956 | Wells et al. | |
| 3,410,217 | A | 11/1968 | Kelley et al. | |
| 6,550,535 | B1 | 4/2003 | Traylor et al. | |
| 6,702,028 | B1 * | 3/2004 | Heggholmen | E21B 43/121 166/105.5 |
| 8,672,033 | B2 | 3/2014 | Crabtree et al. | |
| 9,366,127 | B1 * | 6/2016 | McCoy | E21B 43/38 |
| 2007/0119588 | A1 | 5/2007 | Gonzalez et al. | |
| 2014/0110133 | A1 * | 4/2014 | Ellithorp | E21B 43/127 166/378 |

OTHER PUBLICATIONS

International Preliminary Report on Patentability issued in Application No. PCT/US2015/027062, dated Nov. 10, 2016.

* cited by examiner

CONNECTOR AND GAS-LIQUID SEPARATOR FOR COMBINED ELECTRIC SUBMERSIBLE PUMPS AND BEAM LIFT OR PROGRESSING CAVITY PUMPS

TECHNICAL FIELD OF THE INVENTION

The present invention relates generally to methods and compositions used in the production of hydrocarbons and more specifically to methods and compositions for connecting and gas-liquid separator for combined electric submersible pumps (ESP) and beam lift or progressing cavity pumps (PCP).

BACKGROUND OF THE INVENTION

Without limiting the scope of the invention, its background is described in connection with a downhole apparatus and method used in hydrocarbon production, and in particular to a downhole apparatus and method that improves the rate of production of hydrocarbons using a combination of artificial-lift techniques.

During the process of hydrocarbon production the natural pressure of a reservoir eventually decreases to the point that the pressure in the reservoir may become too low to force fluid from the producing zone to the surface. In response to this reduced pressure artificial-lift techniques may be required. In addition, artificial-lift techniques may be used at the onset of production, depending upon the characteristics of the reservoir. An artificial-lift system is defined as any system which adds energy to the fluid column in a wellbore, with the objective of initiating and improving production from the well. Artificial-lift methods fall into two groups, those that use gas and those that use pumps.

Artificial-lift methods that use pumps have a surface power source to drive a downhole pump assembly to generate a large positive pressure gradient between the exit point of the pump and the surface to increase the rate of fluid transport to the surface. In addition, a downhole pump reduces the pressure between the pump entry point and the wellbore interface with the reservoir to increase the differential pressure between the reservoir and the wellbore to increase the rate of fluid flow into the wellbore. There are several types of specialized downhole pumps in use, e.g., sucker-rod pump (SRP), electrical submersible pumps (ESPs) and progressive cavity pumps (PCPs). All of these pumping systems have a downhole pump that pushes fluid gathered in the wellbore in an upward direction. The fluid that flows from the reservoir into the wellbore usually consists of liquid (oil and/or water), gas and it is not uncommon for some amount of sand and other abrasive solids to be present in the production fluid.

U.S. Pat. No. 8,672,033, entitled, "Method of Improving Performance and Efficiency of Wellbore Pump for Hydrocarbon Production," discloses a method of improving performance or efficiency of a wellbore pump associated with a wellbore and/or for increasing the rate of production of reservoir fluid from a reservoir, in which a wellbore pump is arranged to pump wellbore fluid within the wellbore to a surface. The method includes (a) selecting a wellbore which includes an associated wellbore pump associated with a production tube and arranged within a casing. An annulus is defined as the space between the casing and the pump/production tube. The annulus will ideally fill with reservoir fluid which has a hydrostatic head above the level of an inlet of the wellbore pump.

SUMMARY OF THE INVENTION

The present invention provides a gas-liquid separator/connector for operable connection to a downhole production pump. The connector is a three concentric tube device with a conventional size piece of tubing as the inner of the three tubes. This tube connects the tubing which extends to the surface to the tubing that extends into the well where the ESP is located. The tubes are made such that flow of fluids from the ESP enters the bottom of the connector through the inner tube and are diverted into the largest of the three concentric tubes located as the outside tube. The relatively large space between the inside tube and the outside tube allows for the gas to separate from the liquid. This may be enhanced by the addition of an optional foam breaker across the opening of the annulus formed between the inside and outside tube. The gas continues to rise to the surface in the tubing-casing annulus. The liquid now can enter, by gravity, the third tube that is placed outside the inner tube (the tubing) and the large external tube. This third concentric tube is not as long as the large outer tube and is connected at the bottom to become the entrance to the pump intake for the beam pump or PCP. The pump intake for the beam pump or PCP is a part of the smallest inner tube of the connector. The first attachment means (located on the bottom of the connector) and the second attachment means (located at the top of the connector) are couplings. The first attachment means and the second attachment means may be threaded fittings with a coupling or collar made to match the connection of the production tubing used in the well. The second attachment means is connected to the production tubing string in which is placed either a beam pump or a PCP. The first attachment means may be connected to the production tubing that extends down in the well to a submersible pump. The separator outer wall top edge is open to an annulus as is the top of the third concentric tube inside the connector.

The present invention provides a downhole assembly of an artificial-lift system. The connector is a three concentric tube device with a conventional size piece of tubing as the inner of the three tubes. This tube connects the tubing which extends to the surface to the tubing that extends into the well where the ESP is located. The tubes are made such that flow of fluids from the ESP enters the bottom of the connector through the inner tube and are diverted into the largest of the three concentric tubes located as the outside tube. The relatively large space between the inside tube and the outside tube allows for the gas to separate from the liquid. This may be enhanced by the addition of an optional foam breaker across the opening of the annulus formed between the inside and outside tube. The gas continues to rise to the surface in the tubing-casing annulus. The liquid now can enter, by gravity, the third tube that is placed outside the inner tube (the tubing) and the large external tube. This third concentric tube is not as long as the large outer tube and is connected at the bottom to become the entrance to the pump intake for the beam pump or PCP. The pump intake for the beam pump or PCP is a part of the smallest inner tube of the connector.

The present invention provides a system usable with a well. The connector is a three concentric tube device with a conventional size piece of tubing as the inner of the three tubes. This tube connects the tubing which extends to the surface to the tubing that extends into the well where the ESP is located. The tubes are made such that flow of fluids from the ESP enters the bottom of the connector through the inner tube and are diverted into the largest of the three concentric tubes located as the outside tube. The relatively large space between the inside tube and the outside tube allows for the gas to separate from the liquid. This may be enhanced by the addition of an optional foam breaker across the opening of the annulus formed between the inside and outside tube. The gas continues to rise to the surface in the tubing-casing annulus. The liquid now can enter, by gravity, the third tube that is placed outside the inner tube (the tubing) and the large external tube. This third concentric tube is not as long as the large outer tube and is connected at the bottom to become the entrance to the pump intake for the beam pump or PCP. The pump intake for the beam pump or PCP is a part of the smallest inner tube of the connector.

The present invention provides a method of increasing the rate of production of a reservoir fluid from a reservoir. The connector is a three concentric tube device with a conventional size piece of tubing as the inner of the three tubes. This tube connects the tubing which extends to the surface to the tubing that extends into the well where the ESP is located. The tubes are made such that flow of fluids from the ESP enters the bottom of the connector through the inner tube and are diverted into the largest of the three concentric tubes located as the outside tube. The relatively large space between the inside tube and the outside tube allows for the gas to separate from the liquid. This may be enhanced by the addition of an optional foam breaker across the opening of the annulus formed between the inside and outside tube. The gas continues to rise to the surface in the tubing-casing annulus. The liquid now can enter, by gravity, the third tube that is placed outside the inner tube (the tubing) and the large external tube. This third concentric tube is not as long as the large outer tube and is connected at the bottom to become the entrance to the pump intake for the beam pump or PCP. The pump intake for the beam pump or PCP is a part of the smallest inner tube of the connector.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
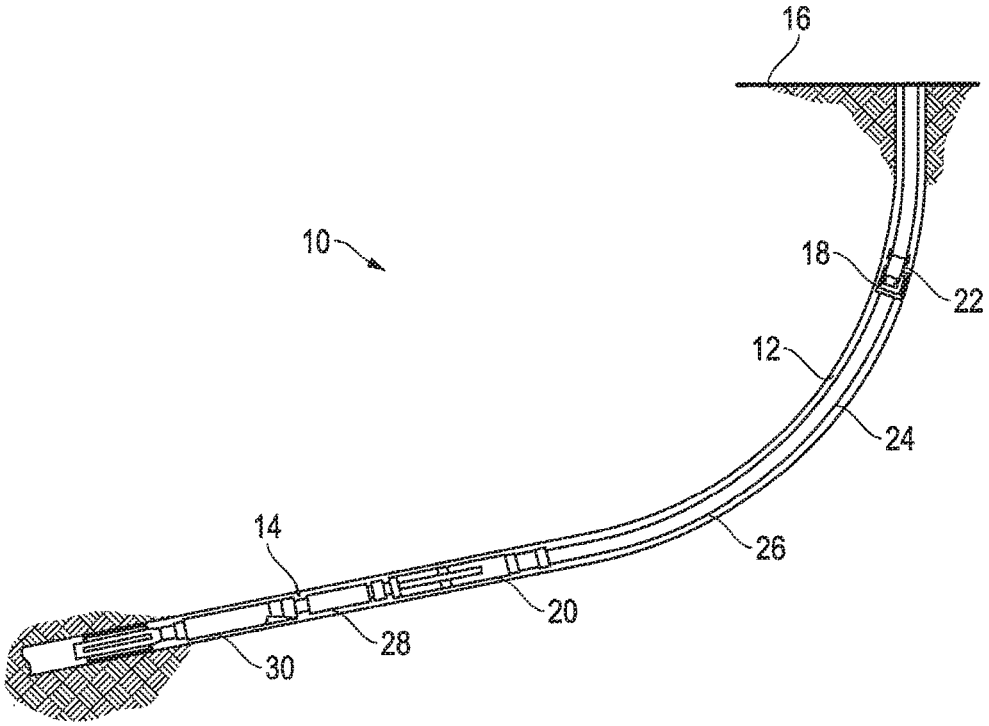
FIG. 1 shows a diagrammatical representation of a first embodiment of a pumping module according to one embodiment of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

As used herein "artificial-lift" refers to the use of artificial means to increase the flow of liquids from a production well. Generally this is achieved by the use of a mechanical device inside the well (known as pump or velocity string) or by decreasing the weight of the hydrostatic column by injecting gas into the liquid some distance down the well. Artificial-lift is needed in wells when there is insufficient pressure in the reservoir to lift the produced fluids to the surface, but often used in naturally flowing wells (which do not technically need it) to increase the flow rate above what would flow naturally. The produced fluid or liquids can be oil, water or a mix of oil and water, typically mixed with some amount of gas.

As used herein "electric submersible pump" (ESP) denotes a downhole pump (a series of centrifugal pumps), an electrical motor which transforms the electrical power into kinetic energy to turn the pump, a separator or protector to prevent produced fluids from entering the electrical motor, and an electric power cable that connects the motor to the surface control panel. An ESP is typically located at the bottom of the production tubing, and includes a downhole electric motor powered and controlled from surface by a power cable which connects to the wellhead. ESPs are highly efficient pumps capable of high production rates, and are particularly well-suited to the production of lighter crude oils, and are less capable with heavy crudes. Generally, ESPs are typically susceptible to gas, sand, gas locks, and internal corrosion.

As used herein "progressive cavity pumps" (PCPs) denote a downhole pump typically attached to the bottom end of a production tubing and includes a rubber stator having a helical internal profile which mates with a rotor having an external screw profile. The rotor is connected to a rotating shaft, which extends through the production tubing and is driven by a motor. The rotation created sequential cavities and the produced fluids are pushed to surface. PCPs are normally specified for their ability to produce heavy crudes.

As used herein "rod pumps" denote long slender cylinders with both fixed and moveable elements inside. The pump is designed to be inserted inside the tubing of a well and its main purpose is to gather fluids from beneath it and lift them to the surface. The components include the barrel, valves (traveling and fixed) and the piston.

As used herein "beam pumps" can also be called rod pumps and denote a pump containing a barrel, a plunger and a pair of valves. The pump is placed on or inside the production tubing and is connected to the surface pumping unit (the "beam") by segmented rods called sucker rods. Such a device is driven by a surface power source, commonly an electric motor or a gas or diesel engine. This turns a pair of cranks attached to pitman arms which by their action converts the rotary mechanism of the motor to the vertical reciprocating motion of the beam. The result is a characteristic nodding motion. The downhole plunger and valve assembly convert the reciprocating motion to vertical fluid movement. Essentially, during the downstroke of the beam the plunger falls through the barrel which has filled with fluid and during the upstroke of the beam the fluid is lifted toward the surface above the plunger while the barrel again fills with fluid.

As used herein "annulus" denotes any void between any piping, tubing or casing and the piping, tubing, or casing immediately surrounding it.

As used herein "recovery well" as used herein is a well from which fluids are recovered to the surface.

As used herein "extending from the surface" when used with respect to a well includes wells drilled from the surface, and wells drilled from another wellbore, e.g., in a multilateral or junction system, with the parent wellbore of such system was drilled from the surface. The "surface" of a well is the uppermost land surface of the land well, and is the mud line of an offshore well. The phrase "controlling flow to the subsurface flow line" includes opening, shutting off, or metering a particular zone for entry to the drainage well.

As used herein "fluid communication" denotes that fluid may flow without a significant pressure differential between two locations. Fluid communication may result from the interception of a formation and a well, from the interception of two wells, or from wells being so close that fluids pass without significant restriction between the two wells, optionally due to perforating or fracing the spacing between the wells.

The term "fluid" as used herein means a liquid or a combination of a liquid and a gas.

All of these pumping systems have a downhole pump that pushes fluid gathered in the wellbore in an upward direction. The fluid that flows from the reservoir into the wellbore usually consists of liquid (oil and/or water) and gas. In wells with a large gas to oil ratio (GOR), the production of fluid can be limited by gas interference in the pump. Gas interference can occur when the gas liberated from a solution produces foam that occupies a significant volume within the wellbore casing surrounding the downhole pump. When the foam is introduced into the pump it reduces pump fillage, thus limiting the liquid intake volume of the pump.

Fluid flows from the reservoir into the wellbore through perforations in casing or liner, or through sectors of the wellbore without any casing or liner in case of open hole completion. The section of the wellbore between the top and bottom location of fluid inlet is called a producing interval. Gas interference may occur if the downhole pump intake is installed above the producing interval, because when the pump is located below the producing interval, a natural separation of gas from liquid occurs before the liquid enters the pump. The gas in the fluid, being less dense than liquid, is displaced (possibly with some liquid) upward and away from the pump intake, while the liquid tends to travel downward towards the pump intake. However, it is not always possible to place the pump intake below the producing interval. In horizontal wells, for example, the pump intake is typically located above or within the producing interval; therefore, if a horizontal well is producing a significant amount of gas, the position of the pump will permit more foam and free gas to enter the pump and decrease pumping efficiency.

Gas separators can be used to help reduce gas interference and improve pumping efficiency when the pump is located above the producing interval. However, if a significant volume of foam is present in the annular space inside the casing surrounding the pump, the gas separators may not operate efficiently. Furthermore, due to the limited amount of free space within the casing annulus (i.e., the annular region surrounding the downhole pump and/or tubing containing rod elements connecting the pump to the surface) around the gas separator, the gas separator will only be able to separate a limited capacity of gas volume.

The connector/gas-liquid separator of the present invention provides a unique opportunity to solve a vexing production problem in horizontal wells, namely the pumping of low volume and low pressure liquids out of the horizontal sections when the reservoirs are pressure depleted, but still capable of producing an economic quantity of oil and gas.

The present invention provides a connector/gas-liquid separator with the ability to combine two separate artificial lift technologies to provide increased performance and/or efficiency of the pumps and/or may reduce wear and/or service intervals of the pumps. The present invention provides a connector/gas-liquid separator that allows the use of a combination of multiple artificial-lift technologies simultaneously.

More specifically, the present invention provides a connector/gas-liquid separator that allows the combination of artificial-lift technologies of electric submersible pumps and beam pumps or progressing cavity pumps. The connector/gas-liquid separator allows an electric submersible pump to be connected below the connector/gas-liquid separator and a second pump to be connected above the connector/gas-liquid separator. The electric submersible pump boosts a gas and liquid mixture to the gas-liquid separator whereby the gas is vented up the tubing-casing annulus and the liquid falls back into the beam pump intake.

This is of particular interest in low liquid volume horizontal oil wells because the electric submersible pump can process small liquid volumes with some gas from the horizontal part of the well, but is incapable of lifting the mixture to the surface. The beam pump is installed in the vertical part of the well, where it is ideally suited, but below the shallowest depth the electric submersible pump can reach. At this point the mixture from the electric submersible pumps is vented into the separator and the liquid allowed to fall by gravity back into the beam pump (or progressive cavity pump) intake. The gas continues up the annulus to the surface along with any gas from the horizontal section that did not enter the electric submersible pumps intake. The liquid is lifted to the surface by the beam pump (or progressive cavity pump). The electrical power cable required for the electric submersible pump is strapped to the outside of the tubing from the surface as in a normal electric submersible pump installation known to the skilled artisan.

The present invention includes a connector/gas-liquid separator positioned at the juncture of the electric submersible pumps and beam pump or progressive cavity pump to insure that only liquid enters the beam pump or progressive cavity pump while the gas pumped by the electric submersible pumps continues up the annulus to the surface.

The connector/gas-liquid separator of the present invention allows the electric submersible pumps to be used to pump oil and water from the horizontal section of a well as far towards the surface as the device can deliver. At this point the beam pump or progressive cavity pump takes over and continues to pump the liquid to the surface. This allows for low volume horizontal oil wells to continue to produce by using two pumps in portions of the well where they are particularly suited.

The connector/gas-liquid separator of the present invention eliminates wear that would otherwise affect a beam pump were it installed in or near the horizontal section. The gas-liquid separator provides a gas free liquid stream to the beam pump intake. The electric submersible pump can process some gas along with the liquid from the horizontal part of the well. This mixture is vented into the gas-liquid separator where the majority of the liquid falls into the pump intake while allowing the gas to continue to the surface up the annulus. It also allows for the lowest producing pressure to be achieved in the well which will maximize the flow rate from the reservoir. If the connector/gas-liquid separator over flows with liquid, the liquid falls back to the bottom of the well where it can be pumped by the electric submersible pump back to the beam pump intake.

The present invention provides a connector/gas-liquid separator that connects a submersible pump and a secondary pump.

FIG. 1 is a side view of a pump assembly in a wellbore in accordance with an exemplary embodiment of the present invention. The pump assembly 10 may be positioned in the wellbore 12 to convey the produced fluids 14 to the surface 16. The pump assembly 10 includes the connector/gas-liquid separator 18 that connects the submersible pump 20 to the beam pump 22. The pipe 26 extends from the submersible pump 20 to the connector/gas-liquid separator 18. The pipe 26 and the connector/gas-liquid separator 18 may be connected via a first threaded engagement or any other connection known to one having ordinary skill in the art. The coupling unit 18 also includes a second threaded engagement (not shown) or any other connection known to one having ordinary skill in the art to connect to the beam pump 22. The second threaded engagement (not shown) may connect directly to the beam pump 22 or may be separated from the beam pump 22 by a segment of piping (not shown). The beam pump 22 is also coupled to the production string 24 via a threaded engagement or any other connection known to one having ordinary skill in the art to supply the produced fluids 14 to the surface 16. The production string 24 and other piping and conduit may be any type of conduit used to collect produced fluids 14 from subterranean formations, including, but not limited to coiled tubing, jointed pipe, and other tubulars.

The submersible pump 20 may be configured to pressurize produced fluids 14 for production at surface 16. The submersible pump 20 may be an electric submersible pump or a progressive cavity pump. In one example, the submersible pump 20 is an electric submersible pump and in some embodiments may be in fluid communication with a gas separator 28 and a motor 30. In some embodiments, a protector (not shown) may be installed between the submersible pump 20 and the motor 30 and a centralizer (not shown) may be installed below the motor 30. Alternatively, the submersible pump 20 may be a charger pump, a tapered pump, or any other type of pump configured to pump oil, water, gas, or other produced fluids 14 through the production string 24 to the surface 16. The submersible pump 20 may be integrally formed with a gas separator 28 or the submersible pump 20 may attach to gas separator 28. The submersible pump 20 is an electrically powered pump that receives power from a power source at the surface 16. As such, electrical connection cables (not shown) are connected from the submersible pump 20 to the surface power supply (not shown) such connections are known to the skilled artisan.

The beam pump (or rod pump) 22 may be configured to pressurize produced fluids 14 for production at surface 16. The beam pump (or rod pump) 22 may be connected through a connection conduit to separate the connector/gas-liquid separator 18 and the beam pump 22 or may be connected directly to the connector/gas-liquid separator 18.

In one embodiment, the connector/gas-liquid separator 18 is a three concentric tube device of a size to fit into the wellbore with conventional size tubing connecting the tubing that extends from the surface to the tubing that extends into the wellbore where the electric submersible pump 20 is located.

Figure 2:
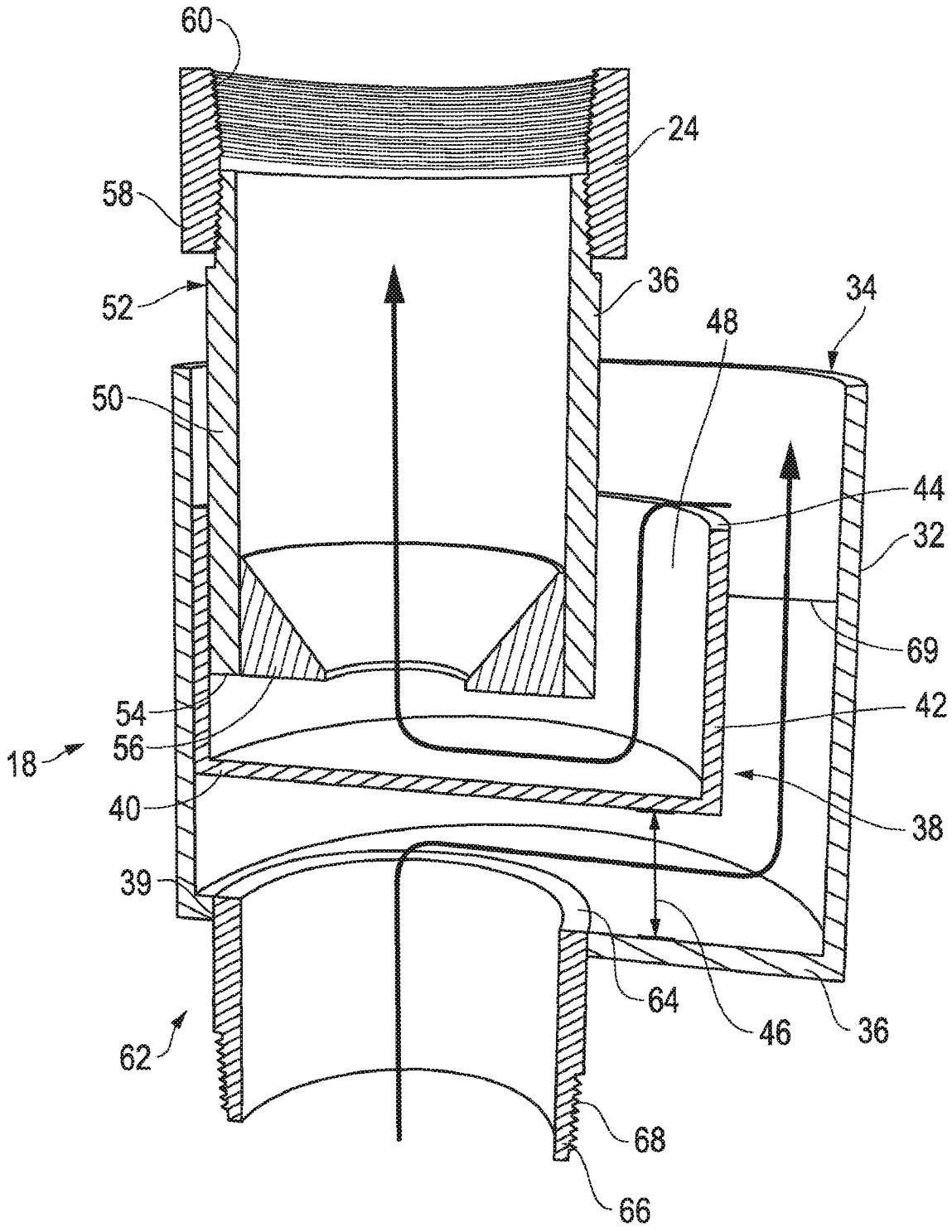
FIG. 2 is a cut away view of the connector/gas-liquid separator of the present invention.

FIG. 2 is a cut-away view of one embodiment of the connector/gas-liquid separator 18 of the present invention. One embodiment of the connector/gas-liquid separator 18 is a three concentric tube design. The separator housing side wall 32 is the first concentric tube and is configured to form the body of the connector/gas-liquid separator 18. The separator housing side wall 32 is connected to a separator housing top 34 and to a separator housing bottom 36. Positioned between the separator housing top 34 and a separator housing bottom 36 is a divider 38 having a diameter less than the diameter of the separator housing 32. The divider 38 has a divider bottom 40 positioned above the separator housing bottom 36 and a divider side wall 42 extending from the divider bottom 40 to a divider top edge 44 that is below the separator housing top 34. A produced fluid supply passage 46 is formed between the separator housing bottom 36 and the divider bottom 40. The produced fluid supply passage 46 extends between the divider side wall 42 and the separator housing side wall 32. The produced fluid supply passage 46 may optionally include a foam breaker 69. The produced fluid supply passage 46 further extends between the separator housing top 34 and the divider top edge 44 to allow access to the divider interior area 48. As a result, the produced fluid supply passage 46 is in fluid communication from the divider interior area 48 to the separator hosing bottom 36.

Although the connector/gas-liquid separator 18 may be made any size that is desired, the connector/gas-liquid separator 18 should be made as large as can fit into the well casing while leaving sufficient clearance for the external electric cable for the electric submersible pump (not shown) or to fish the device out of the well if necessary. The separator housing top 34 can be made as long as needed to make sure little, if any, liquid overflows the connector/gas-liquid separator 18 and falls back into the well before the beam pump or progressive cavity pump can pump it to the surface.

A beam pump connection pipe 50 is connected to the top of the connector/gas-liquid separator 18. The beam pump connection pipe 50 includes a beam pump connection pipe top 52 that extends above the separator housing top 34 and a beam pump connection pipe bottom 54 that extends into the divider interior area 48 at a position below the divider top edge 44. A seating nipple 56 may be optionally positioned in the beam pump connection pipe bottom 54 to allow a space to seat or install the beam lift intake. The connection for a beam pump or a PCP intake can be made internal to the connector by a seating nipple 56. The seating nipple can equally be installed at connection 24 at the exit of the connector (see FIG. 1). The beam pump connection pipe top 52 may include a threaded fitting 58 that mates to a production string threaded fitting 60 to connect the production string 24 to the connector/gas-liquid separator 18 to pump oil, water, gas, or other produced fluids (not shown) to the surface (not shown). An optional foam breaker 69 may be installed.

The separator housing bottom 36 defines an aperture 39, and an ESP connection pipe 62 is connected to the bottom of the connector/gas-liquid separator 18. The electric submersible pump connection pipe 62 includes an electric submersible pump connection pipe top 64 that is sealingly coupled to the aperture 39 of the separator housing bottom 36 and extends at or above the separator housing bottom 36 but below the divider bottom 40 to allow the produced fluid supply passage 46 to be in fluid communication with the electric submersible pump connection pipe 62. The electric submersible pump connection pipe 62 includes a ESP connection pipe bottom 66 having a threaded fitting 68 that mates to the electric submersible pump pipe threaded fitting (not shown) or an electric submersible pump pipe (not shown) which connects the connector/gas-liquid separator 18 to the electric submersible pump (not shown).

Thus, the electric submersible pump is in fluid communication with the ESP pipe which enters the connector/gas-liquid separator 18 through the ESP connection pipe 62. The electric submersible pump connection pipe 62 is in fluid communication with the connector/gas liquid separator 18. The fluid supply passage 46 beam pump connection pipe bottom 54 and allows degassing. The beam pump connection pipe bottom 54 is in fluid communication with the production string 24 to the connector/gas-liquid separator 18 to pump oil, water, gas, or other produced fluids (not shown) to the surface (not shown). Since the electric submersible pump is some distance below the connector/gas-liquid separator suspended on the tubing, there may be no need for a conventional tubing anchor to secure the tubing in the well.

In operation, the connector/gas-liquid separator 18 is made such that flow of fluids from the electric submersible pump enters the bottom of the connector and are diverted into the largest of the three tubes located as the outside tube. The relatively large space between the inside tubing and the outside pipe allows for the gas to separate from the liquid. The gas continues to rise to the surface in the tubing-casing annulus. The liquid now can enter the tube that is inside which is the entrance to the pump intake for the beam pump or progressive cavity pumps. The connection for a beam pump or a PCP intake can be made internal to the connector by a seating nipple 56. The seating nipple can equally be installed at connection 24 at the exit of the connector.

The present invention provides a gas-liquid separator/connector for operable connection to a downhole production pump having a separator housing comprising a separator housing bottom and a separator housing side wall extending from the separator housing bottom to a separator wall top edge; a divider positioned in the separator housing, wherein the divider comprising a divider bottom and a divider side wall extending from the divider bottom to a divider wall top edge, wherein the divider bottom is positioned above the separator housing bottom and the divider wall top edge is positioned below the separator wall top edge; a fluid supply passage formed between the divider bottom and the separator housing bottom and the divider side wall and the separator housing side wall; an aperture in the separator housing bottom; a separator housing inlet comprising an inlet first end sealably fitted to the aperture and an inlet second end comprising a first attachment means; an outlet connection pipe comprising an outlet bottom connected to an outlet top, wherein the outlet bottom is below the divider wall top edge and the outlet top comprises a second attachment means; and wherein the fluid supply passage provides fluid communication between the inlet second end and the outlet top.

The first attachment means (located on the bottom of the connector) and the second attachment means (located at the top of the connector) are couplings. The first attachment means and the second attachment means may be threaded fittings with a coupling or collar made to match the connection of the production tubing used in the well. The second attachment means is connected to the production tubing string in which is placed either a beam pump or a PCP. The first attachment means may be connected to the production tubing that extends down in the well to a submersible pump. The separator outer wall top edge is open to an annulus as is the top of the third concentric tube inside the connector.

The present invention provides a downhole assembly of an artificial-lift system having a first pump positioned above and in fluid communication with a gas-liquid separator/connector and a submersible pump below positioned below and in fluid communication with the gas-liquid separator/connector, wherein the gas-liquid separator/connector comprises a separator housing comprising a separator housing bottom and a separator housing side wall extending from the separator housing bottom to a separator wall top edge; a divider positioned in the separator housing, wherein the divider comprising a divider bottom and a divider side wall extending from the divider bottom to a divider wall top edge, wherein the divider bottom is positioned above the separator housing bottom and the divider wall top edge is positioned below the separator wall top edge; a fluid supply passage formed between the divider bottom and the separator housing bottom and the divider side wall and the separator housing side wall; an aperture in the separator housing bottom; a separator housing inlet comprising an inlet first end sealably fitted to the aperture and an inlet second end is coupled to the submersible pump; and an outlet connection pipe comprising an outlet bottom connected to an outlet top, wherein the outlet bottom is below the divider wall top edge and the outlet top is coupled to the first pump, wherein the fluid supply passage provides fluid communication between the submersible pump and first pump.

The first attachment means and the second attachment means may be couplings or maybe threaded fittings. The first attachment means may be connected to a submersible pump by a connection pipe. The separator wall top edge may be open to an annulus and the divider wall top edge is open to an annulus.

The present invention provides a system usable with a well comprising: a submersible pump disposed downhole in a well to create a fluid flow of a pumped fluid from a reservoir; a gas-liquid separator/connector in fluid communication with the submersible pump to separate liquids and gases and to provide a fluid source; and a second pump in fluid communication with the gas-liquid separator/connector to create a fluid flow of a pumped fluid to an Earth surface of the well, wherein the gas-liquid separator/connector comprises a separator housing comprising a separator housing bottom and a separator housing side wall extending from the separator housing bottom to a separator wall top edge; a divider positioned in the separator housing, wherein the divider comprising a divider bottom and a divider side wall extending from the divider bottom to a divider wall top edge, wherein the divider bottom is positioned above the separator housing bottom and the divider wall top edge is positioned below the separator wall top edge; a fluid supply passage formed between the divider bottom and the separator housing bottom and the divider side wall and the separator housing side wall; an aperture in the separator housing bottom; a separator housing inlet comprising an inlet first end sealably fitted to the aperture and an inlet second end is coupled to the submersible pump; and an outlet connection pipe comprising an outlet bottom connected to an outlet top, wherein the outlet bottom is below the divider wall top edge and the outlet top is coupled to the first pump, wherein the fluid supply passage provides fluid communication between the submersible pump and first pump.

The second attachment means may be connected to a beam pump or a progressive cavity pump. The first attachment means and the second attachment means may be threaded fittings. The separator wall top edge may be open to an annulus and the divider wall top edge is open to an annulus.

The present invention provides a method of increasing the rate of production of a reservoir fluid from a reservoir by selecting a wellbore; providing an submersible pump associated with a production tube and being arranged within a casing, wherein an annulus is defined between the casing and the production tube; providing a gas-liquid separator/connector in fluid communication with the submersible pump to separate liquids and gases and to provide a fluid source; providing a second pump in fluid communication with the gas-liquid separator/connector to create a fluid flow of a pumped fluid to an Earth surface of the well, wherein the gas-liquid separator/connector comprises a separator housing comprising a separator housing bottom and a separator housing side wall extending from the separator housing bottom to a separator wall top edge; a divider positioned in the separator housing, wherein the divider comprising a divider bottom and a divider side wall extending from the divider bottom to a divider wall top edge, wherein the divider bottom is positioned above the separator housing bottom and the divider wall top edge is positioned below the separator wall top edge; a fluid supply passage formed between the divider bottom and the separator housing bottom and the divider side wall and the separator housing side wall; an aperture in the separator housing bottom; a separator housing inlet comprising an inlet first end sealably fitted to the aperture and an inlet second end is coupled to the submersible pump; and an outlet connection pipe comprising an outlet bottom connected to an outlet top, wherein the outlet bottom is below the divider wall top edge and the outlet top is coupled to the first pump; contacting a reservoir fluid with the submersible pump to form a production fluid; pumping the production fluid into the fluid supply passage; passing the production fluid over the divider wall top edge, wherein at least a portion of a gas is separated from the production fluid; pumping the production fluid into the outlet bottom; and pumping the production fluid to the first pump.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A gas-liquid separator/connector for operable connection to a downhole production pump comprising:

a separator housing comprising a separator housing bottom and a separator housing side wall extending from the separator housing bottom to a separator wall top edge;

a divider positioned in the separator housing, wherein the divider comprising a divider bottom and a divider side wall extending from the divider bottom to a divider wall top edge, wherein the divider bottom is positioned above the separator housing bottom and the divider wall top edge is positioned below the separator wall top edge;

a fluid supply passage formed between the divider bottom and the separator housing bottom and the divider side wall and the separator housing side wall;

an aperture in the separator housing bottom;

a separator housing inlet comprising an inlet first end sealably fitted to the aperture and an inlet second end comprising a first attachment means;

an outlet connection pipe comprising an outlet bottom connected to an outlet top, wherein the outlet bottom is below the divider wall top edge and the outlet top comprises a second attachment means; and wherein the fluid supply passage provides fluid communication between the inlet second end and the outlet top, and the only fluid communication between the separator housing and the divider is through an opening defined by the divider wall top edge.

2. The connector of claim 1, wherein the first attachment means and the second attachment means are couplings.

3. The connector of claim 1, wherein the first attachment means and the second attachment means are threaded fittings.

4. The connector of claim 1, wherein the second attachment means is connected to a pump.

5. The connector of claim 1, wherein the second attachment means is connected to a beam pump or a progressive cavity pump.

6. The connector of claim 1, wherein the second attachment means is connected to a production string.

7. The connector of claim 1, wherein the first attachment means is connected to a submersible pump.

8. The connector of claim 1, wherein the first attachment means is connected to a submersible pump by a connection pipe.

9. The connector of claim 1, wherein the separator wall top edge is open to an annulus.

10. The connector of claim 1, wherein the divider wall top edge is open to an annulus.

11. A downhole assembly of an artificial-lift system, comprising:

a first pump positioned above and in fluid communication with a gas-liquid separator/connector and a submersible pump positioned below and in fluid communication with the gas-liquid separator/connector, wherein the gas-liquid separator/connector comprises:

a separator housing comprising a separator housing bottom and a separator housing side wall extending from the separator housing bottom to a separator wall top edge;

a divider positioned in the separator housing, wherein the divider comprising a divider bottom and a divider side wall extending from the divider bottom to a divider wall top edge, wherein the divider bottom is positioned above the separator housing bottom and the divider wall top edge is positioned below the separator wall top edge;

a fluid supply passage formed between the divider bottom and the separator housing bottom and the divider side wall and the separator housing side wall;

an aperture in the separator housing bottom;

a separator housing inlet comprising an inlet first end sealably fitted to the aperture and an inlet second end is coupled to the submersible pump via a first attachment means; and an outlet connection pipe comprising an outlet bottom connected to an outlet top, wherein the outlet bottom is below the divider wall top edge and the outlet top is coupled to the first pump via a second attachment means, wherein the fluid supply passage provides fluid communication between the submersible pump and first pump.

12. The assembly of claim 11, wherein the first attachment means and the second attachment means are couplings or threaded fittings.

13. The assembly of claim 11, wherein the first attachment means is connected to the submersible pump by a connection pipe.

14. The assembly of claim 11, wherein the separator wall top edge and the divider wall top edge is open to an annulus.

15. A system usable with a well, comprising:

a submersible pump disposed downhole in a well to create a fluid flow of a pumped fluid from a reservoir;

a gas-liquid separator/connector in fluid communication with the submersible pump to separate liquids and gases and to provide a fluid source; and a second pump in fluid communication with the gas-liquid separator/connector to create a fluid flow of a pumped fluid to an Earth surface of the well, wherein the gas-liquid separator/connector comprises a separator housing comprising a separator housing bottom and a separator housing side wall extending from the separator housing bottom to a separator wall top edge; a divider positioned in the separator housing, wherein the divider comprising a divider bottom and a divider side wall extending from the divider bottom to a divider wall top edge, wherein the divider bottom is positioned above the separator housing bottom and the divider wall top edge is positioned below the separator wall top edge; a fluid supply passage formed between the divider bottom and the separator housing bottom and the divider side wall and the separator housing side wall; an aperture in the separator housing bottom; a separator housing inlet comprising an inlet first end sealably fitted to the aperture and an inlet second end is coupled to the submersible pump; and an outlet connection pipe comprising an outlet bottom connected to an outlet top, wherein the outlet bottom is below the divider wall top edge and the outlet top is coupled to the second pump, wherein the fluid supply passage provides fluid communication between the submersible pump and second pump.

16. The system of claim 15, wherein the second attachment means is connected to a beam pump or a progressive cavity pump.

17. The system of claim 15, wherein the first attachment means and the second attachment means are threaded fittings.

18. The system of claim 15, wherein the separator wall top edge is open to an annulus.

19. The system of claim 15, wherein the divider wall top edge is open to an annulus.

20. A method of increasing the rate of production of a reservoir fluid from a reservoir comprising the steps of:

selecting a wellbore;

providing a submersible pump associated with a production tube and being arranged within a casing, wherein an annulus is defined between the casing and the production tube;

providing a gas-liquid separator/connector in fluid communication with the submersible pump to separate liquids and gases and to provide a fluid source;

providing a second pump in fluid communication with the gas-liquid separator/connector to create a fluid flow of a pumped fluid to an Earth surface of the well, wherein the gas-liquid separator/connector comprises a separator housing comprising a separator housing bottom and a separator housing side wall extending from the separator housing bottom to a separator wall top edge; a divider positioned in the separator housing, wherein the divider comprising a divider bottom and a divider side wall extending from the divider bottom to a divider wall top edge, wherein the divider bottom is positioned above the separator housing bottom and the divider wall top edge is positioned below the separator wall top edge; a fluid supply passage formed between the divider bottom and the separator housing bottom and the divider side wall and the separator housing side wall; an aperture in the separator housing bottom; a separator housing inlet comprising an inlet first end sealably fitted to the aperture and an inlet second end is coupled to the submersible pump; and an outlet connection pipe comprising an outlet bottom connected to an outlet top, wherein the outlet bottom is below the divider wall top edge and the outlet top is coupled to the second pump;

contacting a reservoir fluid with the submersible pump to form a production fluid;

pumping the production fluid into the fluid supply passage;

passing the production fluid over the divider wall top edge, wherein at least a portion of a gas is separated from the production fluid;

pumping the production fluid into the outlet bottom; and pumping the production fluid to the second pump.

* * * * *